US005486417A

United States Patent [19]

Hagen et al.

[11] Patent Number: 5,486,417

[45] **Date of Patent: *Jan. 23, 1996**

[54] MIXED CROSS-SECTION CARPET YARN

[75] Inventors: Gerry A. Hagen, Anderson; Wei Li, Salem, both of S.C.

[73] Assignee: BASF Corporation, Parsippany, N.J.

[ * ] Notice: The term of this patent shall not extend beyond the expiration date of Pat. No. 5,413,857.

[21] Appl. No.: 373,813

[22] Filed: Jan. 17, 1995

Related U.S. Application Data

[63] Continuation of Ser. No. 128,454, Sep. 28, 1993, Pat. No. 5,413,857.

[51] Int. Cl.[6] ..... D02G 3/00

[52] U.S. Cl. ..... 428/357; 428/362; 428/364; 428/373; 428/397; 428/92; 57/252; 57/253; 57/246; 57/248

[58] Field of Search ..... 428/92, 362, 369, 428/367, 370, 357, 397, 364; 57/252, 253, 246, 248

[56] References Cited

U.S. PATENT DOCUMENTS

| | | | |
|---|---|---|---|
| Re. 29,352 | 8/1977 | Newton | 57/140 |
| 2,750,653 | 6/1956 | White et al. | 28/31 |
| 3,033,240 | 5/1962 | Bottorf . | |
| 3,109,220 | 11/1963 | McKinney et al. | 139/420 |
| 3,220,173 | 11/1965 | Pitzl | 57/140 |
| 3,321,448 | 5/1967 | Hebeler | 260/78 |
| 3,350,871 | 11/1967 | Pierce et al. | 57/140 |
| 3,465,618 | 9/1969 | McIntosh et al. | 76/107 |
| 3,745,061 | 7/1973 | Champaneria et al. | 161/178 |
| 3,802,177 | 4/1974 | Sekiguchi et al. | 57/140 |
| 3,994,122 | 11/1976 | Shah | 57/140 |
| 4,001,369 | 1/1977 | Shah | 264/177 |
| 4,255,487 | 3/1981 | Sanders | 428/368 |
| 4,472,481 | 9/1984 | Snooks, Jr. et al. | 428/362 |
| 4,492,731 | 1/1985 | Bankar | 428/362 |
| 4,621,022 | 11/1986 | Kohaut et al. | 428/397 |
| 4,770,938 | 9/1988 | Peterson et al. | 428/398 |
| 4,882,222 | 11/1989 | Talley, Jr. et al. | 428/362 |
| 5,108,838 | 4/1992 | Tung | 428/357 |
| 5,175,038 | 12/1992 | Tung et al. | 428/92 |
| 5,190,821 | 3/1993 | Goodall et al. | 428/398 |
| 5,208,106 | 5/1993 | Tung | 428/397 |
| 5,208,107 | 5/1993 | Yeh et al. | 428/397 |
| 5,322,736 | 6/1994 | Boyle et al. | 428/397 |
| 5,413,857 | 5/1995 | Hagen et al. | 428/357 |

FOREIGN PATENT DOCUMENTS

| | | |
|---|---|---|
| 3176005 | 7/1991 | Japan . |
| 3180529 | 8/1991 | Japan . |

*Primary Examiner*—N. Edwards

[57] ABSTRACT

A blend of fibers is made of about 51 to 90% by weight of base fibers (a) selected from triangular trilobal fibers having a modification ratio ranging from 2.4 to 3.4; hollow pentagonal fibers; standard trilobal fibers having a modification ratio of at least 2.6; pointed lobe trilobal fibers having a modification ratio of at least 2.6; and mixtures thereof; and about 10 to 49% by weight of accent fibers (b) selected from standard trilobal fibers having a modification ratio ranging from 1.7 to 2.4; pointed lobe trilobal fibers having a modification ratio ranging from 2.0 to 2.9; and mixtures thereof. The fibers (a) and (b) have a denier per filament within the range represented by the area enclosed by sides A, B, C, D and E of FIG. 1. Where fibers (a) and (b) are both pointed lobe trilobal fibers with the same modification ratio and denier per filament, then fibers (a) are delustered and fibers (b) are undelustered.

9 Claims, 6 Drawing Sheets

TRIANGULAR TRILOBAL,MR=2.4 AND 3.4

TRIANGULAR TRILOBAL, MR=2.4 AND 3.4

HOLLOW PENTAGONAL

TRILOBAL, MR=2.6

TRILOBAL, MR=1.7 and 2.4

POINTED LOBE TRILOBAL, MR=2.0 and 2.9

MIXED CROSS-SECTION CARPET YARN

This is a continuation of application Ser. No. 08/128,454 filed on Sep. 28, 1993, issuing as U.S. Pat. No. 5,413,857 on May 9, 1995.

FIELD OF THE INVENTION

This invention relates generally to blends of fibers and yams made therefrom. More particularly, this invention relates to blends of carpet fibers having an excellent overall combination of high bulk, high luster, firm hand and dye uniformity.

BACKGROUND OF THE INVENTION

As used in this specification, the following terms have the associated meanings:

The term "modification ratio" or "MR" means the ratio of the radius $R_2$ of the circumscribed circle to the radius $R_1$ of the inscribed circle as shown in FIG. 3.

The term "arm angle" or "A" is the angle formed by extension of the sides of an arm as shown in FIG. 3.

The term "trilobal" refers to fibers having three lobes and a modification ratio greater than 1. These trilobal fibers have lobes substantially without convex curves where such convex curves are connected cusps along the contour of the lobe.

The term "pointed lobe trilobal" refers to a trilobal fiber cross-section where each lobe is defined with reference to a single arm angle and each arm angle is greater than $56\times MR^{-1.5}$.

The term "standard trilobal" refers to a trilobal fiber cross-section where each lobe is defined with reference to a single arm angle and each arm angle is less than or equal to $56\times MR^{-1.5}$.

The term "triangular lobal" refers to a fiber cross-section having lobes and a base portion. The base portion without the lobes is approximately triangular. The lobes are present at the apexes (tips) of the triangle. Exemplary triangular lobal fibers are the smaller fibers shown in FIG. 3. Fibers of this cross-section are sometimes referred to as having a "fox cross-section" because the cross-section resembles a fox's head. The triangular lobal cross-section is characterized by three lobes and two arm angles, $A_0$ and $A_1$. $A_0$ typically may range from 0° to 25° and $A_1$ typically may range from 60° to 110°.

The term "fiber" refers to both filaments (strands of indefinite or continuous length) and staple (strands of short and definite length).

In the production of fiber for use in carpets, it is desirable to produce fiber that will provide carpet having a pleasing appearance with respect to cover, firmness and luster. It is known to increase carpet cover per carpet weight by using trilobal fibers having a high modification ratio. However, increasing the modification ratio usually results in a reduction in luster. The present invention involves mixed filament yarns which provide a surprisingly excellent balance of qualities when used in carpet.

U.S. Pat. No. Re 29,352 to Newton discloses the broad concept of mixing fibers and is primarily directed to an interlacing method for forming heather fabrics.

U.S. Pat. No. 3,220,173 to Pitzl describes trilobal filaments having a modification ratio falling within a range around a mean modification ratio in the range of 1.4 to 2.5.

These filaments are not true mixed filaments, but rather a preset range of cross-sections around a mean filament shape.

U.S. Pat. No. 3,994,122 to Shah describes a blend of crimped staple fibers for use in carpet. The blend comprises two components or groups of trilobal fibers of the same denlet, one group having a modification ratio between 1.6 and 1.9, and the other group having a modification ratio between 2.2 and 2.5. While the blend of fibers is described as providing improved appearance when compared to carpets produced from fibers of either component alone, there is still substantial room for further improvements along these lines.

U.S. Pat. No. 4,001,369, also to Shah, describes a process for co-spinning the trilobal filamentary yarn described in U.S. Pat. No. 3,994,122.

U.S. Pat. No. 4,472,481 to Shooks, Jr. et al. describes a trilobal fiber blend having 70% to 90% by weight of a crimped trilobal polyamide fiber with a modification ratio between 3 and 3.4 and a denlet from 16 to 2,4, and 30% to 10% by weight of crimped trilobal polyamide fibers with a modification ratio ranging from 1.7 to 2.4 and a denlet ranging from 6 to 12.

U.S. Pat. Nos. 5,208,106 and 5,108,838, both to Tung, describe lobal fiber cross-sections where the lobes have substantially convex curves connected by cusps along the contour of each lobe.

U.S. Pat. No. 4,770,938 to Peterson describes a trilobal fiber having an axially extending hole in each lobe. The total cross-sectional void area is 5 to 12% and arm angles of about 15° to 45°.

U.S. Pat. No. 4,492,731 to Bankar et al. describes trilobal carpet fibers in a specified range of modification ratio and related arm angles.

U.S. Pat. No. 5,208,107 to Yeh et al. describes a trilobal fiber with a single axially extending central void. The cross-sectional void area is 3–10%. The modification ratio is between 3 and 10 and the arm angle is between about 7° and about 35°.

While blends of fibers have been shown to provide various results, there is still room for improvement in the quality of appearance and texture of carpet yams.

SUMMARY OF THE INVENTION

The present invention fills a void in the art by providing a blend of fibers comprising about 51 to 90% by weight of base fibers (component (a)) selected from the group consisting of triangular trilobal fibers having a modification ratio ranging from 2.4 to 3.4 and preferably 2.5 to 3.2, hollow pentagonal fibers, standard trilobal fibers having a modification ratio of at least 2.6, pointed lobe trilobal fibers having a modification ratio of at least 2.6 and mixtures thereof; and about 10 to 49% by weight of accent fibers (component (b)) selected from the group consisting of standard trilobal fibers having a modification ratio ranging from 1.7 to 2.4 and pointed lobe trilobal fibers having a modification ratio ranging from 2.0 to 2.9. All the fibers have a denier per filament within the range represented by the area enclosed by sides A, B, C, D and E of FIG. 1. When both fibers (a) and fibers (b) are pointed lobe trilobal fibers with the same modification ratio and denier, then fibers (a) are delustered and fibers (b) are undelustered.

In an especially preferred embodiment, the present invention provides a blend of fibers comprising about 51 to 90% by weight of triangular trilobal fibers (component (a)) having a denier per filament of less than about 22 and about 10 to 49% by weight of pointed lobe trilobal fibers (component Co)) having a denier per filament of about 18 to 36.

It is an object of the present invention to provide a carpet yarn for making carpet with optimum luster, texture, hand, soil hiding and cover.

After reading the following description, related objects and advantages of the present invention will be apparent to those ordinarily skilled in the art to which the invention pertains.

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

The present invention is a blend of fibers which maintains high cover without sacrificing luster when made into carpet. Surprisingly, in one preferred embodiment, this luster is present and even enhanced when one of the component filaments is delustered.

The fiber blends of the present invention include about 51 to 90% by weight of base fibers (component (a)) and about 10 to 49% by weight of accent fibers (component (b)). The fiber components (a) and (b) have a denier per filament ("dpf") within the range represented by the area enclosed by sides A, B, C, D and E of FIG. 1. More preferably, the range of deniers is within the range represented by sides A', B', C', D' and E' of FIG. 2. If both component (a) and component (b) are pointed lobe trilobal fibers having the same denier, modification ratio and arm angle, then component (a) is delustered and component (b) is undelustered, i.e., bright.

Figure 3:
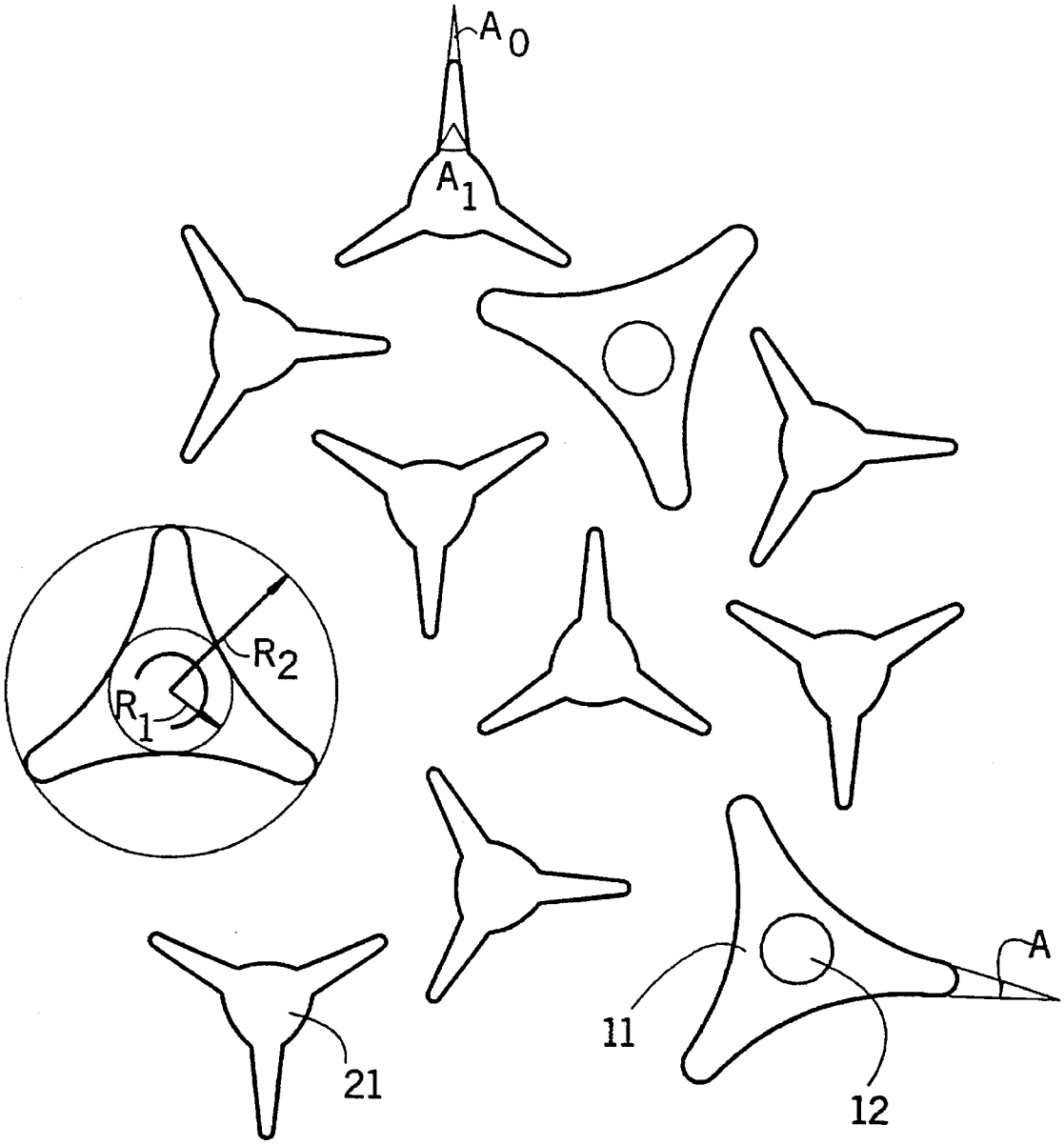
FIG. 3 is an enlarged cross-sectional representation of a mixed fiber yarn having triangular trilobal base fibers and pointed lobe trilobal accent fibers, according to the present invention.
Figure 4:
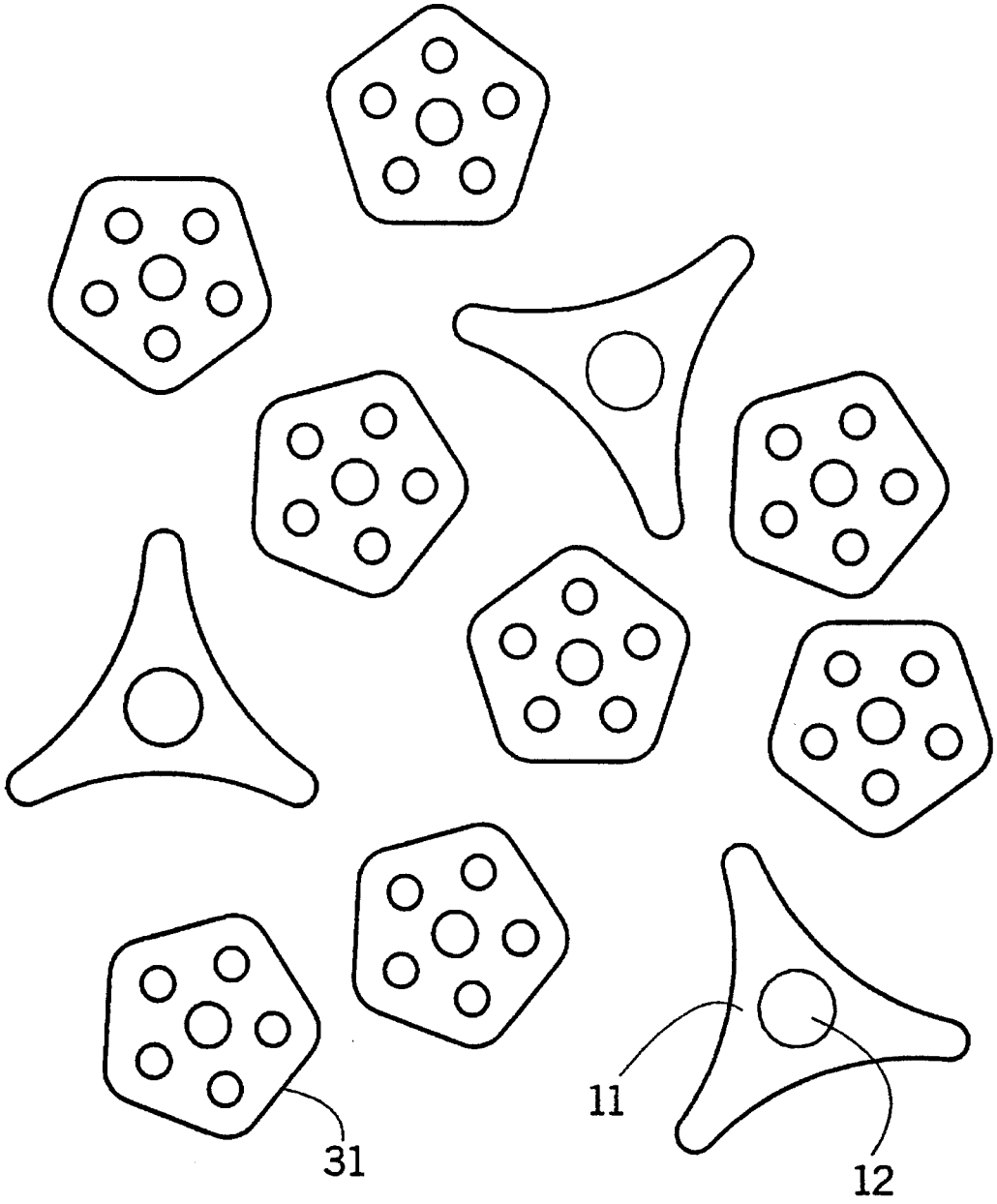
FIG. 4 is an enlarged cross-sectional representation of another mixed fiber yarn having hollow pentagonal base fibers and pointed lobe trilobal accent fibers, according to the present invention.

The base fiber may be one or more of a group of common carpet fiber cross-sections. Exemplary base fiber cross-sections are shown in FIGS. 6A, 6B, 6C and 6E. The cross-sections in the figures are exemplary only and demonstrate the range limits of MR contemplated. It will be readily understood by those of ordinary skill in the art that a continuum of cross-sections having modification ratios between those shown in FIG. 6 are within the scope of the invention. These carpet fiber cross-sections include triangular trilobal fibers having a modification ratio ranging from 2.4 to 3.4 (FIG. 6A), hollow pentagonal fibers (FIG. 6B), standard trilobal fibers having a modification ratio of at least 2.6 (FIG. 6C), pointed lobe trilobal fibers having a modification ratio of at least 2.6 (FIG. 6E MR=2.9) and mixtures of these fibers. Preferably, component (a) base fibers are triangular trilobal fibers 21 as shown in FIG. 3. They may or may not be crimped according to known crimping methods such as air jet, stuffer box and false-twisting methods. The base fibers may be symmetric or asymmetric due to unequal leg lengths, leg angles or curvature in the legs. Component (a) base fibers preferably have a denier ranging from 12 to 24. One or more axial voids may or may not be present. Axial voids are those which are co-extensive with the longitudinal axis of the fiber. When voids are present, a single central axial void is preferable. When hollow pentagonal fibers are present, one or more voids may be present. A preferable pentagonal cross-section 31 is shown in FIG. 4.

Figure 6A:
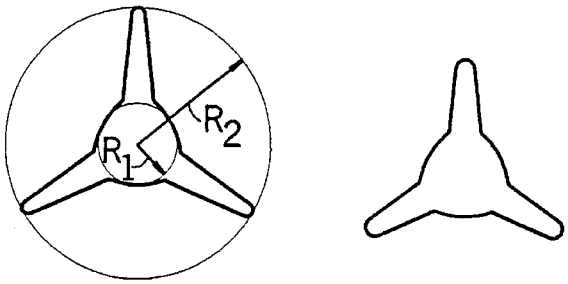
FIG. 6A is an enlarged cross-sectional representation of two exemplary triangular trilobal base fibers useful in the present invention.
Figure 6B:
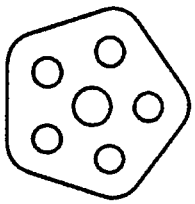
FIG. 6B is an enlarged cross-sectional representation of an exemplary hollow pentagonal base fiber useful in the present invention.
Figure 6C:
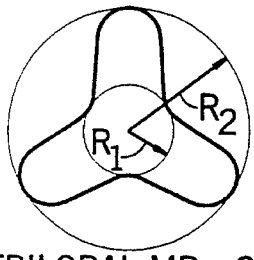
FIG. 6C is an enlarged cross-sectional representation of an exemplary standard trilobal base fiber useful in the present invention.
Figure 6D:
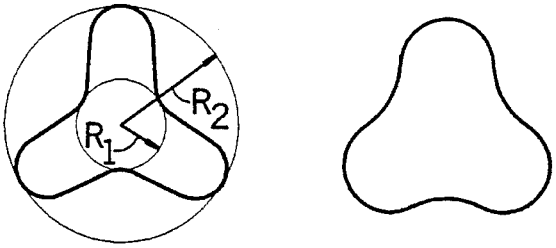
FIG. 6D is an enlarged cross-sectional representation of two standard trilobal accent fibers useful in the present invention.
Figure 6E:
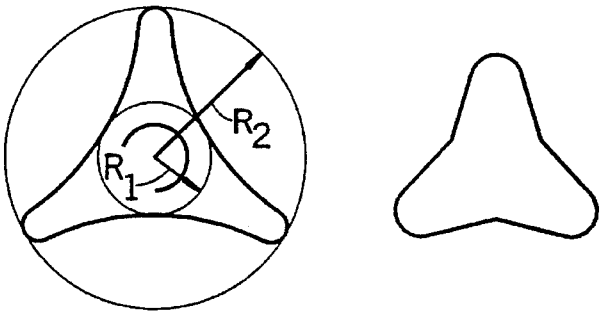
FIG. 6E is an enlarged cross-sectional representation of two standard pointed lobe trilobal fibers both useful as accent fibers and one useful as a base fiber (MR≧ 2.6) in the present invention.

Component (b) fibers are accent fibers which assist in providing the superior luster of carpets made from the mixed fibers of the present invention. They also assist to balance the cover, hand and soil hiding properties of carpets as well as improve carpet dye uniformity. Component (b) accent fibers may or may not be crimped according to standard crimping procedures for carpet fibers as described above. Exemplary accent fiber cross-sections are shown in FIGS. 6D and 6E. The cross-sections in the figures are exemplary only and demonstrate in some cases the range limits of MR contemplated. It will be readily understood by those of ordinary skill in the art that a continuum of cross-sections having modification ratios between those shown in FIG. 6 are within the scope of the invention. Most preferably, the fibers of component (b) accent fibers are pointed lobe trilobal fibers with a modification ratio ranging from 2.0 to 2.9 (FIG. 6E) or low modification ratio standard trilobal fibers with a modification ratio ranging from 1.7 to 2.4 (FIG. 6D). Pointed trilobal fibers are also shown as the large fibers 11 in FIG. 3. Component (b) accent fibers may or may not have at least one central axial void. The cross-section may be symmetric or asymmetric due to unequal leg lengths, leg angles or curvature in the legs.

It is contemplated that small amounts of other fibers may be present in the blends such as, for example, conductive fibers of the type disclosed in U.S. Pat. No. 4,255,487 to Sanders.

In a preferred embodiment, the base fiber (a) is delustered by the addition of up to about 0.30% $TiO_2$. Surprisingly, it was discovered that the addition of the delustering agent actually enhances the sparkle evident when the fiber is used as a carpet yarn and constructed into carpet. Even more surprisingly, the enhanced sparkle affect was observed where both base fiber (a) and accent fiber (b) are pointed lobe trilobals which differ only in the presence or absence of a delustering agent.

An especially preferred embodiment of the present invention is represented in FIG. 3. Component (b) consists of pointed lobe trilobal fibers 11 which are present at about 10% to 49%, preferably 10% to 20%, by weight. These fibers preferably have a modification ratio ranging from 2.3 to 2.8 and a denier per filament ranging from about 18 to about 36 but preferably at least 22. Although voids 12 are shown, they may or may not be present. Most preferably, pointed lobe trilobal fibers 11 are bright.

The remaining 51% to 90% and preferably 80% to 90% of fibers in FIG. 3 are primarily component (a) and consist of fibers 21 having a generally triangular trilobal cross-section with a modification ratio ranging from 2.7 to 3.0 and a denier per filament ranging from 16 to 22 but preferably less than 20. Component (a) may or may not have voids. Preferably, triangular trilobal fibers 21 are delustered with 0.10% to 0.15% by weight $TiO_2$.

Another embodiment of the invention is shown in FIG. 4. Component (b) consists of 10% to 49% of pointed lobe trilobal fibers 11 having a denier per filament of from about 18 to about 36. Component (a) consists of 51% to 90% of hollow pentagonal fibers 31.

Figure 5:
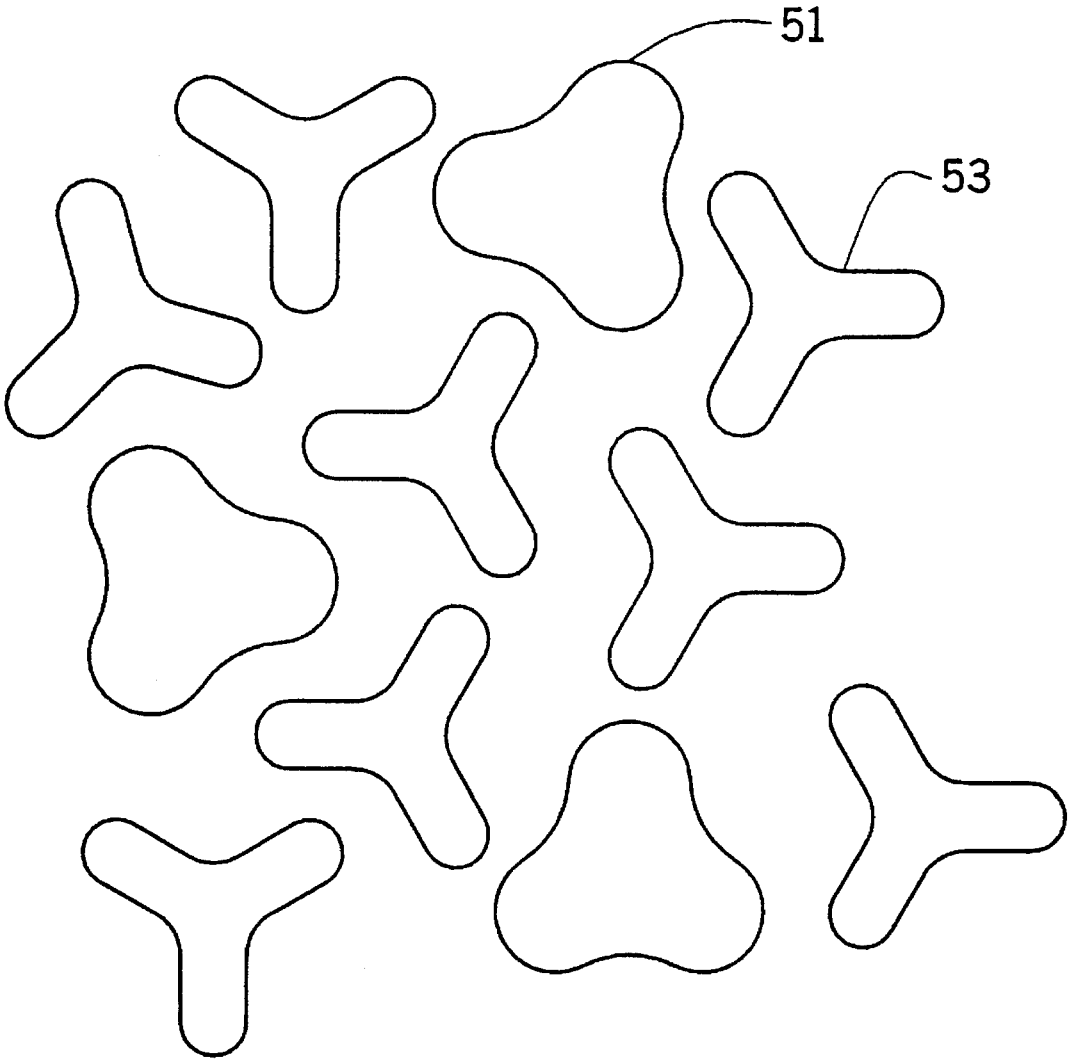
FIG. 5 is an enlarged cross-sectional representation of yet another mixed fiber yarn having standard trilobal base fibers and standard trilobal accent fibers, according to the present invention.

A further embodiment of the invention is shown in FIG. 5. Component (b) consists of 10% to 49% of standard trilobal fibers 51 having a modification ratio of 2.4 and a denier per filament of from about 18 to 36. Component (a) consists of 51% to 90% of standard trilobal fibers 53 having a modification ratio greater than 2.6 and an arm angle less than 13.4.

Polyamides useful in preparing the fiber blends of the invention include nylon 6,6 (polyhexamethylene adipimide) and nylon 6 (poly-$\epsilon$-caprolactam). Other polyamides include the common nylons, such as nylon 11, nylon 6,10 and copolymers of nylon 6,6 and nylon 6, such as nylon 6,6/6 and nylon 6,6/6TA, where 6TA is hexamethylene terephthalamide units. Polyesters and other fiber forming polymers are useful as well.

The fibers of the blends may contain conventional additives incorporated therein, such as delusterants (e.g., $TiO_2$), heat and light stabilizers, dye agents, and the like. Normally, such additives are added to the monomers during polymerization or to molten polymer prior to fiber formation. The fibers may be pigmented or conventionally dyed.

Fiber blends of the present invention may be melt spun according to the known or later developed methods for spinning the type of polymer. Conventional winding or spin-draw-texture processes may be used.

A fiber blend in the form of continuous filament yarn may be conveniently prepared by forming the blend during melt spinning. This can be accomplished by using a single spinneret adapted to spin component (a) and component (b) in the appropriate ratio which are then converged to form yarn. When a single spinneret is used the different deniers per filament and the different cross-sections should be controlled through spinneret design and precise manufacturing. Alternatively, separate spinnerets may be used for forming each of the component filaments. The filaments are then combined in the appropriate ratio to form yarn. The yarn may be drawtextured to provide a crimped yarn, or a plurality of such yarns may be combined to form a tow.

Staple yarn may be used but continuous filaments are preferred.

Another aspect of this invention is a carpet made with the mixed filament yarn of the present invention. The yarn may be tufted or woven according to known procedures for doing so. Especially, the yarn makes a superior level loop carpet having very evident sparkle.

The invention will be described by reference to the following detailed Examples. The Examples are set forth by way of illustration, and are not intended to limit the scope of the invention. In the Examples, all parts are part by weight unless otherwise specified.

METHODS

In the Examples below, carpet luster, hand, tip definition and cover were assessed by a panel of at least four persons.

EXAMPLE 1

A mixed cross-section bulked continuous filament ("BCF") yarn is made with two cross-sectional components. Both components are bright (undelustered) filaments made from nylon 6 polymer having 2.7 relative viscosity (RV). The two components are made separately using a spin-winding process.

For component (a), nylon 6 at 270° C. is supplied to a spinneret to achieve a throughput of 176 g/min. The quench air flow is 82 ft/min (7.5 m/min). For component (b), nylon 6 at 275° C. is supplied to a spinneret to achieve a throughput of 71.5 g/min. The quench air flow is 80 ft/min (24.4 m/min). The winding speed for both components is 650 m/min.

Component (a) is spun using a 68-hole triangular trilobal spinneret and component (b) is spun using a spinneret with 14 Y-shaped orifices. Spin-winding conditions for these two component feed yarns are adjusted so the yarns have similar tensile properties. The two different yarns are fed together into a drawtexturing machine.

A 3.0 mechanical draw ratio is applied and the other operating conditions are adjusted to obtain a target yarn with 12.5% hot water bulk and 40 tangles per meter. The resultant BCF yarn comprises: (a) 68 triangular trilobal filaments with a 2.9 modification ratio and 15.0 dpf and (b) 14 standard trilobal filaments with a 1.8 modification ratio and 28.6 dpf. The mixed yarn is, therefore, 1420 denier with 82 filaments.

The mixed cross-section BCF yarn is then cable twisted at 4.0 twists per inch, Superba heatset and tufted into 35 oz/yd$^2$, ⅝" pile height, and 5/32" gauge cut pile carpet. The sample carpet of filament mixture exhibits significantly brighter luster with very little loss in cover power as compared to a carpet made of 100% triangular trilobal filaments with similar carpet construction.

EXAMPLE 2

A mixed cross-section BCF yarn is made with two components. Both components are made from a 2.7 RV nylon 6 polymer and have the same hollow pointed lobe trilobal cross-section of 2.7 modification ratio. The differences between these two components are: 1) one is bright and the other is delustered; and (2) they have different filament deniers. The two components are made separately in a spinwinding process.

For component (a), nylon 6 at 270° C. is supplied to a spinneret to achieve a throughput of 176 g/min. The quench air flow is 82 m/min (2.5 m/min). For component (b), nylon 6 at 275° C. is supplied to a spinneret to achieve a throughput of 71.5 g/min. The quench air flow is 80 ft/min (24.4 m/min). The winding speed for both components is 650 m/min.

Component (a) is spun using a spinneret with 68 hollow pointed lobe trilobal orifices. A master batch nylon 6 chip containing 30% $TiO_2$ is fed to the extruder. The master batch feed rate is controlled to obtain a spun yarn containing 0.3% $TiO_2$. Component (b) is spun using a 14-hole spinneret with the orifice shape identical to those for component (a). Spin-winding conditions for these two component feed yarns are adjusted to make the two components have similar tensile properties.

The two different yarns are then fed together into a drawtexturing machine. A 3.0 mechanical draw ratio is applied and the draw godet temperature and interlacing air pressure are adjusted to obtain a BCF yarn with 12.5% hot water bulk and 40 tangles per meter. The resultant BCF yarn comprises: (a) 68 delustered filaments with 20.3 dpf and (b) 14 bright filaments with 30 dpf. The whole yarn is, therefore, 1800 denier with 82 filaments.

The mixed cross-section BCF yarn is then air entangled, space dyed and tufted into level loop carpets with ⅛" gauge, 3/16" pile height, and 8, 9, and 10 stitches per inch. These sample carpets of filament mixture exhibit high cover power, firm hand and high sparkling effect.

EXAMPLE 3

A BCF yarn with mixed cross-section filaments is made using a spin-draw-texture process. All filaments are made from undelustered nylon 6 polymer of 2.7 RV. A single spinneret having two different kinds of capillaries is used to make the yarn so that the yarn contains two filament components. For both components, nylon 6 at 265° C. is supplied at 252 g/min to the spinneret. The quench air flow is 90 ft/min (27.4 m/min ). The spinning speed is 800 m/min and the drawing speed is 2400 m/min. The spin and draw godets are set at 50° C. and 150° C., respectively.

Component (a) consists of 56 filaments having a triangular trilobal cross-section, 2.80 average modification ratio and about 13.7 dpf. Component (b) contains 13 filaments having an asymmetric pointed lobe trilobal cross-section, 2.87 average modification ratio and about 26.8 dpf. The mixed yarn is, therefore, 1100 denier with 69 filaments.

The mixed cross-section BCF yarn is then cable twisted at 4.5 twists per inch, autoclave heatset and tufted into a 9/16" pile height, ⅛" gauge, 8 stitches per inch, cut pile carpet and a 3/16" pile height, 1/10" gauge, 8 stitches per inch, level loop carpet. Compared to carpets of the same constructions made of 100% triangular trilobal cross-section filaments produced under identical spin-drawtexturing conditions, the mixed cross-section carpets exhibit significantly brighter luster and similar cover power.

Figure 1:
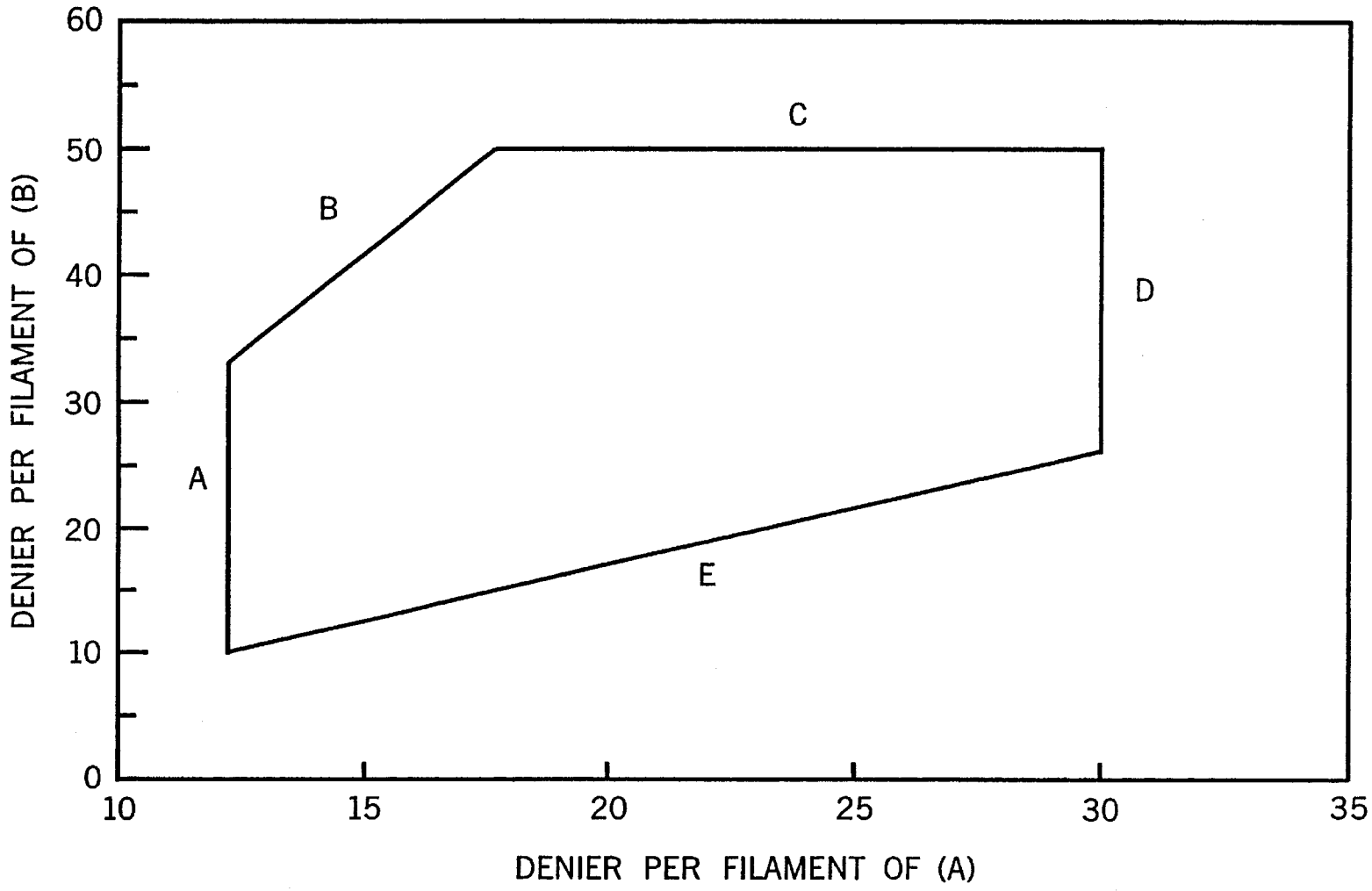
FIG. 1 is a graph showing the area bounded by sides A, B, C, D and E which define limits of the denier parameters for mixed fibers of the present invention.
Figure 2:
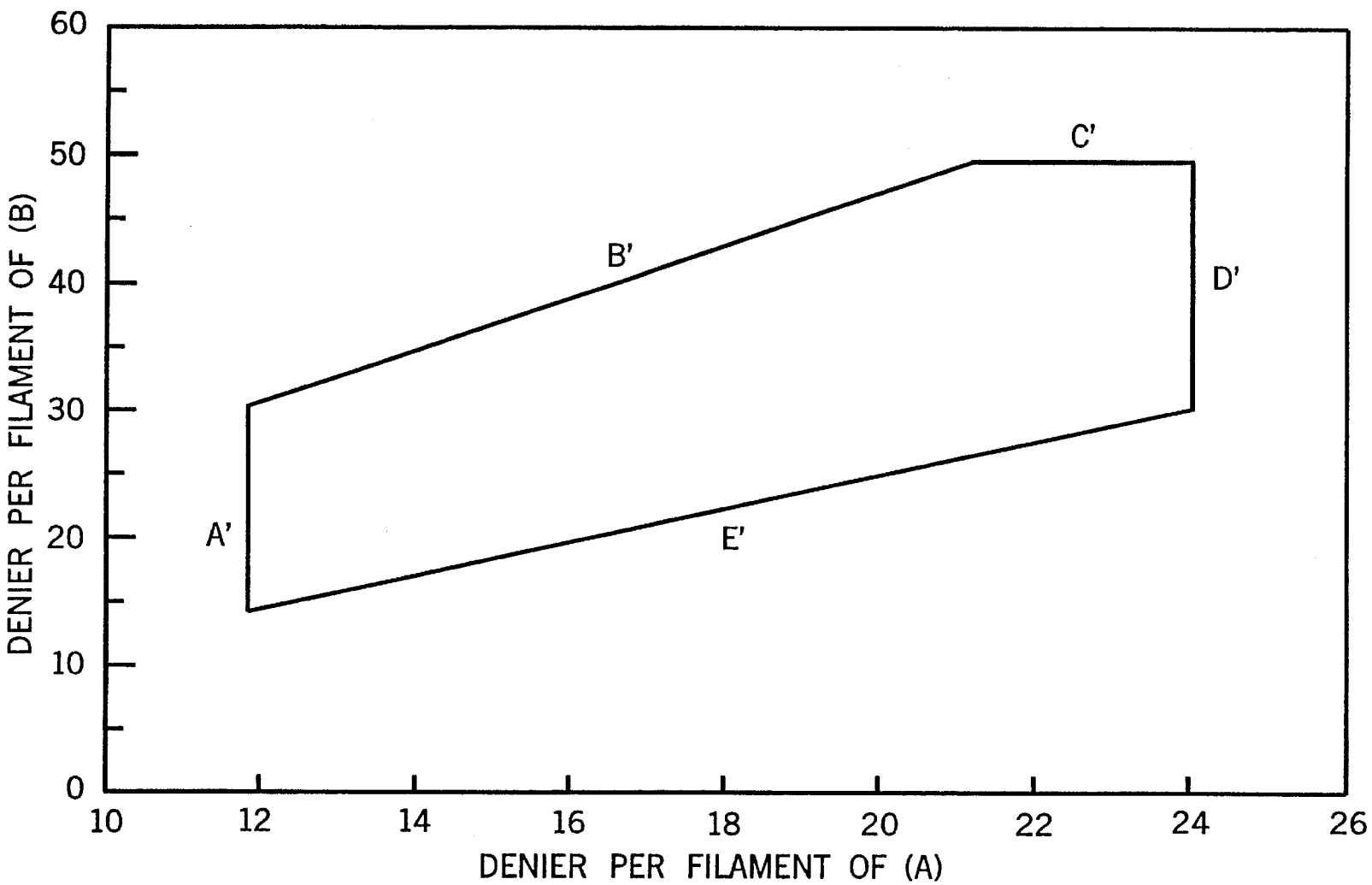
FIG. 2 is a graph showing more preferred denier parameters for mixed fibers of the present invention.

What is claimed is:

1. A blend of fibers comprising:

about 51 to 90% by weight of base fibers (a) selected from the group consisting of triangular trilobal fibers having a modification ratio ranging from 2.4 to 3.4; hollow pentagonal fibers; standard trilobal fibers having a modification ratio of at least 2.6; pointed lobe trilobal fibers having a modification ratio of at least 2.6; and mixtures thereof; and about 10 to 49% by weight of accent fibers (b) selected from the group consisting of standard trilobal fibers having a modification ratio ranging from 1.7 to 2.4; pointed lobe trilobal fibers having a modification ratio ranging from 2.0 to 2.9; and mixtures thereof;

said fibers (a) and (b) having a denier per filament within the range represented by the area enclosed by sides A, B, C, D and E of FIG. 1 and when said fibers (a) and (b) are both pointed lobe trilobal fibers with the same modification ratio and denier per filament, said fibers (a) are delustered and said fibers (b) are not delustered.

2. The blend of claim 1 wherein said denier per filament of (a) and (b) is within the range represented by the area enclosed by sides A', B', C', D' and E' of FIG. 2.

3. The blend of claim 2 wherein said fibers (a) and (b) are crimped.

4. The blend of claim 1 wherein said blend has from 40 to 260 total filaments.

5. The blend of claim 4 wherein said filaments are in the form of a single yarn.

6. The blend of claim 1 wherein said fibers (a) and (b) are undelustered.

7. The blend of claim 1 wherein said base fibers (a) are delustered and said fibers (b) are undelustered.

8. The blend of claim 1 wherein said fibers (b) are pointed lobe trilobal fibers with a modification ratio ranging from 2.0 to 2.9.

9. The blend of claim 8 wherein said fibers (b) have a central axial void.

* * * * *

UNITED STATES PATENT AND TRADEMARK OFFICE

CERTIFICATE OF CORRECTION

PATENT NO. : 5,486,417

DATED : January 23, 1996

INVENTOR(S) : Gerry A. Hagen
Wei Li

It is certified that error appears in the above-identified patent and that said Letters Patent is hereby corrected as shown below:

At column 2, line 6, please delete "denlet" and replace it with "denier".

At column 2, line 19, please delete "2,4" and replace it with "24".

At column 2, line 21, please delete "denlet" and replace it with "denier".

At column 6, line 28, please delete "7.5" and replace it with "25".

At column 6, line 67, please delete "2.5" and replace it with "25".

Signed and Sealed this

Ninth Day of July, 1996

Bruce Lehman

*Attest:*

BRUCE LEHMAN

*Attesting Officer*

*Commissioner of Patents and Trademarks*